US011732465B2

(12) United States Patent
Austin et al.

(10) Patent No.: US 11,732,465 B2
(45) Date of Patent: Aug. 22, 2023

(54) SYSTEM AND METHOD FOR MODULAR CONSTRUCTION

(71) Applicant: PRE-FORM SYSTEMS, San Diego, CA (US)

(72) Inventors: Douglas Austin, San Diego, CA (US); Scott Isaacs, Calgary (CA); Darrin Newnham, Calgary (CA)

( * ) Notice: Subject to any disclaimer, the term of this patent is extended or adjusted under 35 U.S.C. 154(b) by 0 days.

(21) Appl. No.: 17/325,144

(22) Filed: May 19, 2021

(65) Prior Publication Data

US 2022/0002991 A1 Jan. 6, 2022

Related U.S. Application Data

(60) Provisional application No. 63/027,210, filed on May 19, 2020.

(51) Int. Cl.

| | |
|---|---|
| ***E04B 1/68*** | (2006.01) |
| ***E04B 1/30*** | (2006.01) |
| ***E04B 1/344*** | (2006.01) |
| ***E04B 5/36*** | (2006.01) |
| ***E04C 3/34*** | (2006.01) |
| ***E04H 1/00*** | (2006.01) |
| *E04B 1/94* | (2006.01) |

(52) U.S. Cl.

CPC ..... *E04B 1/6807* (2013.01); *E04B 1/30* (2013.01); *E04B 1/344* (2013.01); *E04B 5/36* (2013.01); *E04C 3/34* (2013.01); *E04H 1/005* (2013.01); *E04B 1/947* (2013.01); *E04B 2103/02* (2013.01)

(58) Field of Classification Search

CPC ..... E04B 1/30; E04B 1/344; E04B 1/6807; E04B 5/36; E04B 2103/02; E04C 3/34

USPC ..... 52/251

See application file for complete search history.

(56) References Cited

U.S. PATENT DOCUMENTS

| | | | | |
|---|---|---|---|---|
| 924,405 | A * | 6/1909 | Vought | E04G 11/18 249/189 |
| 2,970,676 | A * | 2/1961 | Maciunas | E04B 1/24 52/262 |
| 3,613,325 | A * | 10/1971 | Yee | E04B 1/20 52/236.8 |

(Continued)

FOREIGN PATENT DOCUMENTS

| | | | | |
|---|---|---|---|---|
| DE | 202013100098 U1 * | 7/2014 | | E06B 1/62 |
| WO | WO-2010099936 A2 * | 9/2010 | | E04F 13/06 |

*Primary Examiner* — Brian D Mattei
*Assistant Examiner* — Joseph J. Sadlon
(74) *Attorney, Agent, or Firm* — Donald L. Wenskay

(57) ABSTRACT

A building module for use in construction of a building comprising a deck oriented in a horizontal plane and a plurality of hollow structural members extending downwardly from around a periphery of the deck. A method of constructing a building comprising placing a plurality of prefabricated modules according to a floor plan to form a story of the building, pouring concrete into the hollow structural members of the plurality of modules to form structural columns, pouring concrete onto the decks of the plurality of prefabricated modules for form structural slabs, and allowing the structural columns and structural slabs to set to complete the story of the building. Embodiments include a plurality of techniques for sealing adjacent prefabricated modules and for installing a balcony on the prefabricated modules.

3 Claims, 9 Drawing Sheets

(56) References Cited

U.S. PATENT DOCUMENTS 3,750,366 A * 8/1973 Rich, Jr. ..... E04B 1/34807 52/79.8
3,815,864 A * 6/1974 Loeber ..... B28B 21/86 249/183
3,822,853 A * 7/1974 Shelley ..... E04G 11/02 249/185
3,830,025 A * 8/1974 Wainshal ..... E04B 1/34823 52/79.14
3,949,532 A * 4/1976 Jonsson ..... B32B 5/245 52/270
3,968,611 A * 7/1976 de Munck ..... E04B 1/6807 52/396.02
4,081,936 A * 4/1978 Wise ..... E04B 1/21 52/236.7
4,125,973 A * 11/1978 Lendrihas ..... E04B 1/2403 249/188
4,151,687 A * 5/1979 Kephart, Jr. ..... E04B 1/344 52/631
4,204,373 A * 5/1980 Davidson ..... E06B 1/64 52/127.7
4,620,404 A * 11/1986 Rizk ..... E04B 1/3483 52/510
4,644,708 A * 2/1987 Baudot ..... E04B 1/3483 52/79.9
4,726,158 A * 2/1988 Fagnoni ..... E04B 1/34357 52/79.5
4,751,947 A * 6/1988 Landers ..... H02G 9/06 141/1
4,761,927 A * 8/1988 O'Keeffe ..... E04B 1/6812 52/459
4,922,676 A * 5/1990 Spronken ..... E04B 1/681 52/396.05
5,050,358 A * 9/1991 Vladislavic ..... E04B 1/161 52/250
5,643,488 A * 7/1997 Lee ..... B28B 7/22 249/34
5,678,375 A * 10/1997 Juola ..... E04B 1/24 52/236.7
5,737,895 A * 4/1998 Perrin ..... E04C 2/384 52/745.1
5,966,956 A * 10/1999 Morris ..... E04B 1/3444 52/79.5
6,219,989 B1 * 4/2001 Tumura ..... E04B 1/2403 52/274
6,586,080 B1 * 7/2003 Heifetz ..... B32B 11/04 428/317.1
6,820,382 B1 * 11/2004 Chambers ..... E04B 1/948 428/40.1
7,127,865 B2 * 10/2006 Douglas ..... E04C 2/20 52/270
7,461,492 B1 * 12/2008 Francies, III ..... E04B 1/483 52/432
7,513,081 B2 * 4/2009 Armstrong ..... E04B 1/14 52/79.9
7,661,232 B2 * 2/2010 Smith ..... E04B 1/6801 52/396.04
7,823,351 B2 * 11/2010 Tiberi ..... B29C 44/1233 52/404.4
8,590,261 B2 * 11/2013 Deiss ..... E06B 1/62 52/211
8,631,616 B2 * 1/2014 Carrion ..... E04G 21/16 52/250
8,991,632 B2 * 3/2015 Minnette ..... B65D 81/3453 220/359.3
9,441,359 B1 * 9/2016 Hsieh ..... E04B 1/3483
10,011,971 B1 * 7/2018 Neathery ..... B29C 33/3842
10,384,378 B2 * 8/2019 O'Leary ..... E04B 1/7654
10,508,432 B2 * 12/2019 Theriot ..... E04B 1/2403
10,683,661 B2 * 6/2020 Bigelow ..... E04F 21/1805
10,927,542 B2 * 2/2021 St. Germain ..... E04B 1/68
2011/0185661 A1 * 8/2011 Nauck ..... E06B 1/62 52/745.15
2011/0258944 A1 * 10/2011 Radoane ..... E04B 1/6803 52/220.8
2018/0065312 A1 * 3/2018 Yates ..... C09J 7/22
2020/0095758 A1 * 3/2020 Wong ..... E04B 1/043

* cited by examiner

HYBRID MODULAR - SELF ALIGNMENT PIN SYSTEM

SYSTEM AND METHOD FOR MODULAR CONSTRUCTION

FIELD OF INVENTION

The present invention generally relates to the field of modular building construction systems. More particularly, the disclosed embodiments relate to a system and method of assembly for prefabricated modular building units used in combination with traditional methods and materials of construction to construct buildings of any possible height up to the limits imposed by building codes, including high-rise buildings.

BACKGROUND

This section is intended to provide a background or context to the disclosed embodiments that are recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The typical cost of construction for high rise buildings is inflated by the cost of onsite labor, particularly when onsite labor-intensive tasks are performed higher and higher above ground level. As construction activities move up a tall building, labor rates increase, and production becomes less efficient for a number of reasons including the necessity of moving project materials by crane or elevator to get the materials to their final installation location. At higher elevations, movement of both materials and labor slows down, increasing construction schedule times and again adding to the construction cost.

As areas urbanize higher density and increased land cost make high-rise buildings a necessity. Higher density also provides higher value to communities and to the environment. It reduces resource use by limiting vehicle trips and reduces development footprints to leave more undisturbed natural land elsewhere in the city or outside of city limits.

Unfortunately in many economic climates high rise building has become unfeasible due to the high cost of this building type. Since income from building operations is solely reliant upon economic conditions, the only way to make this building type viable in many situations is to reduce the cost of construction. Since the construction costs related to conventional methods of construction are also solely reliant upon economic conditions, the construction cost may be reduced by replacing some of the onsite work with prefabricated factory work, and also by reducing the total onsite construction time.

SUMMARY OF THE INVENTION

This section is intended to provide a summary of certain exemplary embodiments and is not intended to limit the scope of the embodiments that are disclosed in this application.

In one embodiment, the disclosed invention describes a method of constructing a building that includes placing a plurality of modules according to a floor plan to form a story of the building, each module comprising a deck oriented in a horizontal plane and a plurality of hollow structural members extending downwardly from around a periphery of the deck. Concrete may then be poured concrete into the hollow structural members of the plurality of modules to form structural columns. Concrete may then be poured onto the decks of the plurality of modules for form structural slabs. the structural columns and structural slabs are then allowed to set to complete the story of the building.

These and other advantages and features of disclosed embodiments, together with the organization and manner of operation thereof, will become apparent from the following detailed description when taken in conjunction with the accompanying drawings.

DETAILED DESCRIPTION OF CERTAIN EMBODIMENTS

Figure 1:
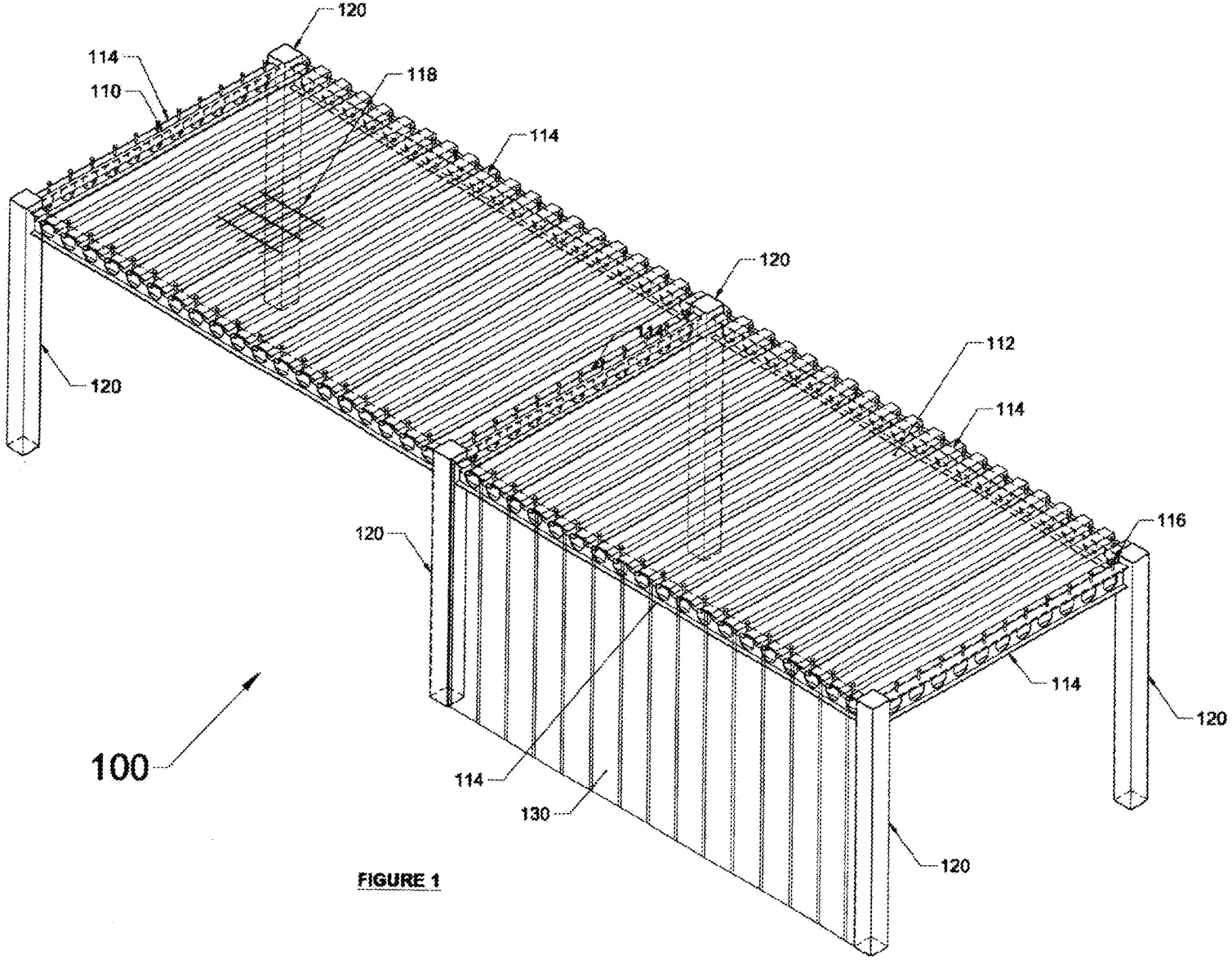
FIG. 1 illustrates an example module according to embodiment of the present disclosure.

In the following description, for purposes of explanation and not limitation, details and descriptions are set forth in order to provide a thorough understanding of the disclosed embodiments. However, it will be apparent to those skilled in the art that the present invention may be practiced in other embodiments that depart from these details and descriptions.

Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner.

The disclosed embodiments relate to systems and methods for modular building construction systems. More particularly, the disclosed embodiments relate to a system and method of assembly for prefabricated modular building units used in combination with traditional methods and materials of construction to construct buildings of any possible height up to the limits imposed by building codes, including high-rise buildings.

The following describes modules for construction of buildings, and methods for constructing buildings with such modules. In some embodiments, the modules are configured to accommodate construction of mid-rise and high-rise buildings, and are also useful for construction of buildings with lower heights.

The modules are configured to be placed according to a desired floor plan to form a building story on a supporting surface. The supporting surface may be a foundation or a previously completed building story. Once the modules are in place, concrete is poured into columns of the modules and over decks of the modules, and the concrete allowed to set to complete the building story. In some embodiments, the modules, together with the concrete, comprise all or substantially all of the structural system of the building.

In some embodiments, modules according to the present disclosure may be used to construct buildings having less concrete than buildings made with some prior art construction methods. In some embodiments, modules according to the present disclosure may be used to construct buildings while requiring less formwork than when constructing buildings according to some prior art construction methods.

In some embodiments, the modules have reinforcement members pre-installed on the decks and/or in the columns thereof. In other embodiments, reinforcement members may be placed on-site. The reinforcement members may, for example, comprise steel bars, wire mesh, or other structurally reinforcing elements. In some embodiments, the interiors of the modules are partially or fully furnished, other than the floors. In some embodiments, the exteriors of the modules may also be partially or fully finished.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

FIG. 1 shows an example module 100 according to one embodiment of the present disclosure. The module 100 comprises a structural deck 110 having a plurality of hollow structural steel (HSS) columns 120 extending downwardly therefrom. One or more wall assemblies 130 may be installed between the columns 120.

Only one wall assembly 130 is shown in FIG. 1, but it is to be understood that the number and configuration of wall assemblies 130 can vary depending on the design and intended use of the building. Each wall assembly 130 may, for example, include one or more doors, windows, built-in storage, workstations, furniture, and/or other features. The exteriors of the wall assemblies 130 of certain modules may also be finished in some embodiments.

The columns 120 may be distributed about the perimeter of the deck 110 and spaced apart as required to support the expected loads. In the illustrated example, the module 100 comprises a rectangular deck 110, with six columns 120 distributed with four at the corners of the deck 110 and two at the midpoints of the longer sides. In other embodiments, the deck 110 may have a different shape, and/or a different number of columns 120 may be provided.

The deck 110 is constructed from a rigid material configured to support a concrete floor poured thereon, and textured to engage the concrete. In the illustrated example, the deck 110 is constructed from a corrugated steel panel 112 with beams 114 attached between the columns 120 around the edges thereof. Another beam 114 extends between the two columns 120 at the midpoint of the deck 110. The beams 114 may, for example, comprise steel I-beams or open-web steel joists. The beams 114 may have studs 116 welded thereabove and extending upwardly therefrom to engage concrete. The studs 116 may be welded to join the underlying portion of the panel 112 and beam 114 in one puddle of weld material.

In some embodiments, the deck 110 may have reinforcement members 118 pre-installed thereon. In the illustrated example, the reinforcement members 118 comprise a grid of steel bars, only a portion of which is shown in FIG. 1, but which may extend across the whole upper surface of the deck 110.

The columns 120 are hollow, and the tops of the columns 120 are slightly higher than the deck 110. After the module 100 is in place, concrete is poured down through the interiors of the columns 120, and then on the deck 110, as described below. In some embodiments, the tops of the columns 120 comprise alignment flanges (not shown) extending upwardly therefrom to facilitate alignment of another column directly thereabove, as described below.

Figure 2A:
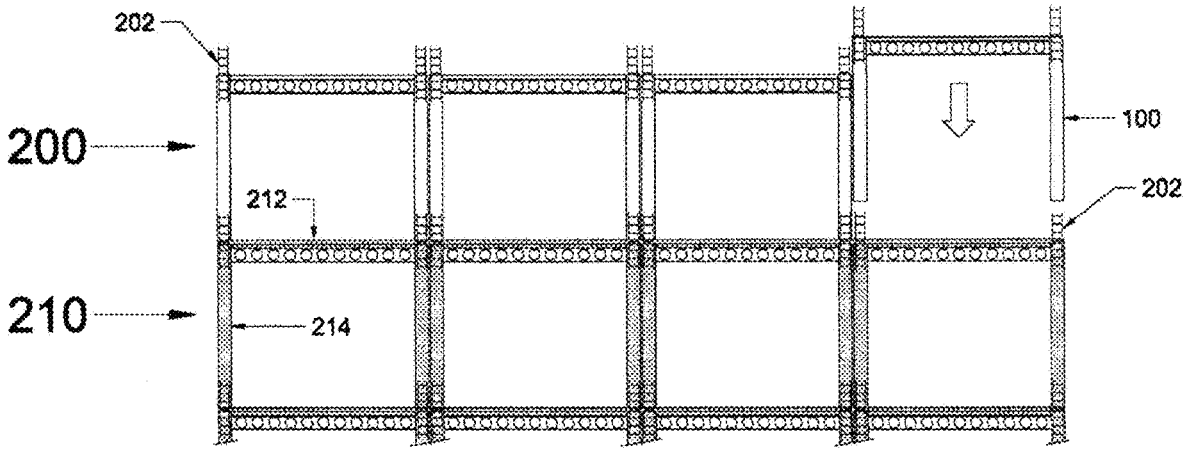
FIGS. 2A-2C show steps of an example method for construction according to one embodiment of the present disclosure.
Figure 2B:
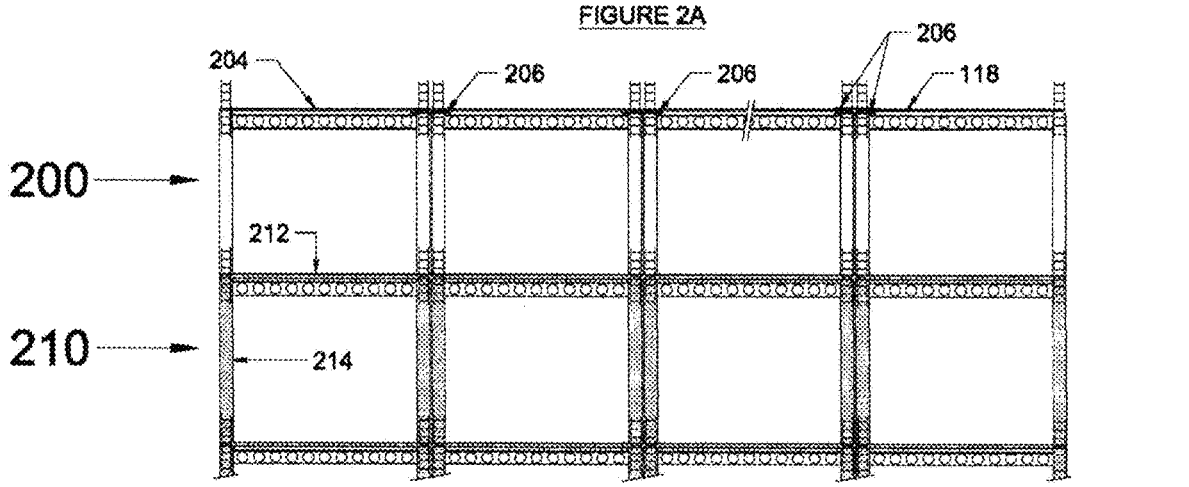
Figure 2C:
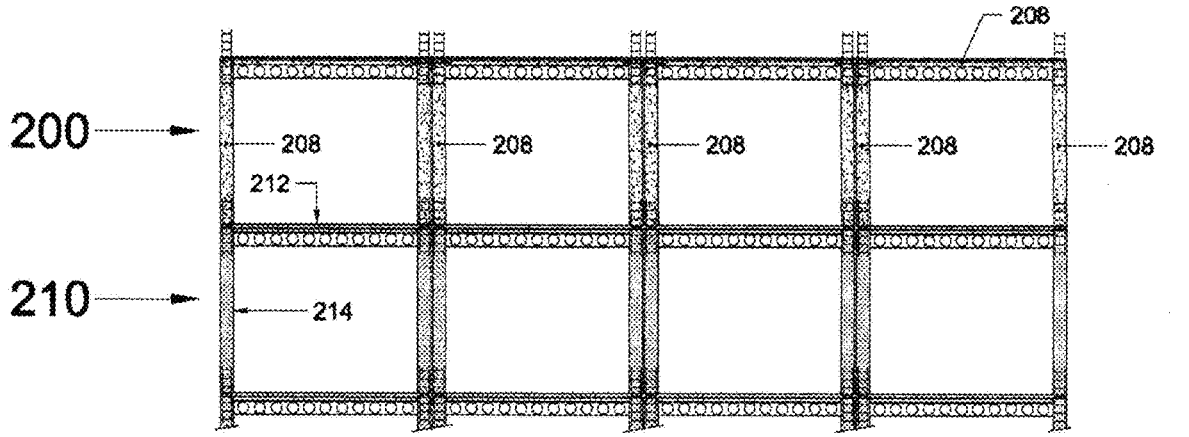

FIGS. 2A, 2B and 2C show steps of an example method for constructing a building according to one embodiment of the present disclosure. As shown in FIG. 2A, a plurality of modules (such as, for example module 100 of FIG. 1), are placed according to a floor plan to form a new building story 200. The modules of the new building story 200 are placed on a supporting structure, which may comprise a foundation (not shown), or a previously completed story 210. Column tie bars 202 are provided in the supporting structure to be received within the columns of the modules. In some embodiments, the columns of the modules have built-in column tie bars 202 extending from the tops thereof (other than the columns of the top-most story).

As shown in FIG. 2B, once the modules of the new building story 210 are in place, deck reinforcement members 204 and inter-module reinforcement members 206 are placed on top of the decks of the modules. The deck reinforcement members 204 may, for example, comprise a wire mesh or a grid of steel bars, such as reinforcement members 118 shown in FIG. 1.

The inter-module reinforcement members 206 may, for example comprise steel bars placed in the troughs of corrugated steel panels of the decks. In some embodiments, the inter-module reinforcement members 206 are preinstalled on the modules.

As shown in FIG. 2C, concrete 208 is poured into columns of the modules, then immediately after the columns are filled concrete is poured to cover the deck of the modules. The concrete 208 is then allowed to set to form a complete story 210 having a floor slab 212 and a plurality of concrete-filled columns 214.

Figure 3A:
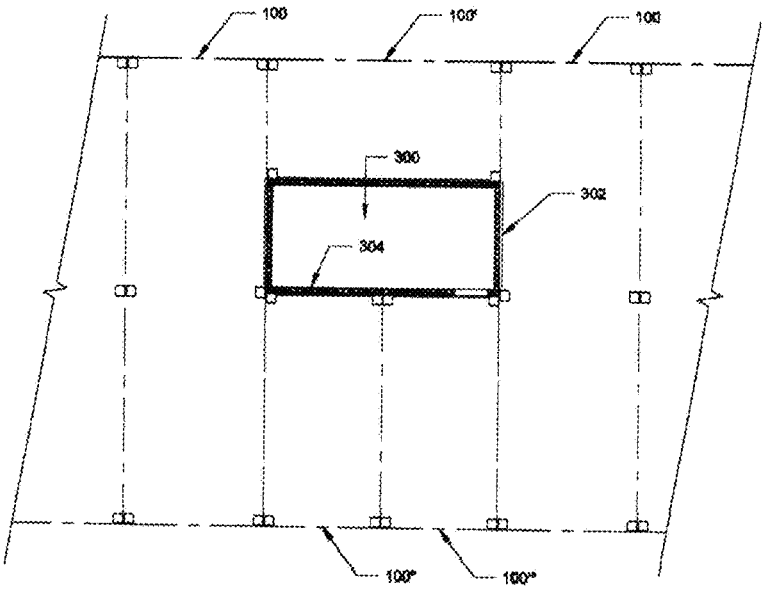
FIG. 3A is a top view of a building with an example elevator core formed by modules according to one embodiment of the present disclosure.
Figure 3B:
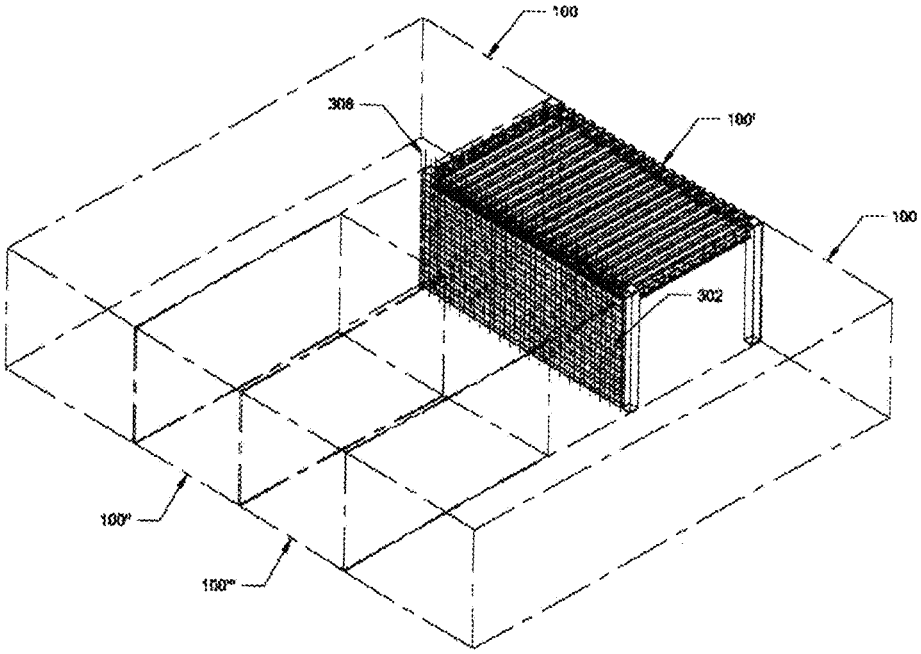
FIG. 3B illustrates a view of the portion of the building in FIG. 3A showing an example module with pre-installed formwork and reinforcement members according to one embodiment of the present disclosure.

FIGS. 3A and 3B show a portion of an example building having a stair/elevator core 300 formed by modules according to the present disclosure. The example building of FIG. 3 includes two modules 100 according to the FIG. 1 embodiment, and three modules 100', 100" and 100'" with different geometries that surround the core 300, each of which modules includes formwork 302 incorporated into the exterior sides of portions of the wall assemblies thereof. Such formwork 302 is configured to support sprayed concrete 304 such that the core 300 can be formed on-site as the building is constructed. As shown in FIG. 3B, in some embodiments the modules also have core reinforcement members 306 pre-installed on the walls thereof.

Figure 4B:
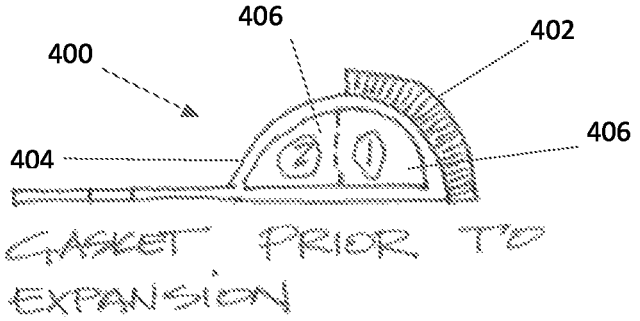
FIGS. 4A-C illustrate a self-sealing internal expanding gasket system used with the modules shown in FIGS. 2A-2C according to one embodiment of the present disclosure.
Figure 4A:
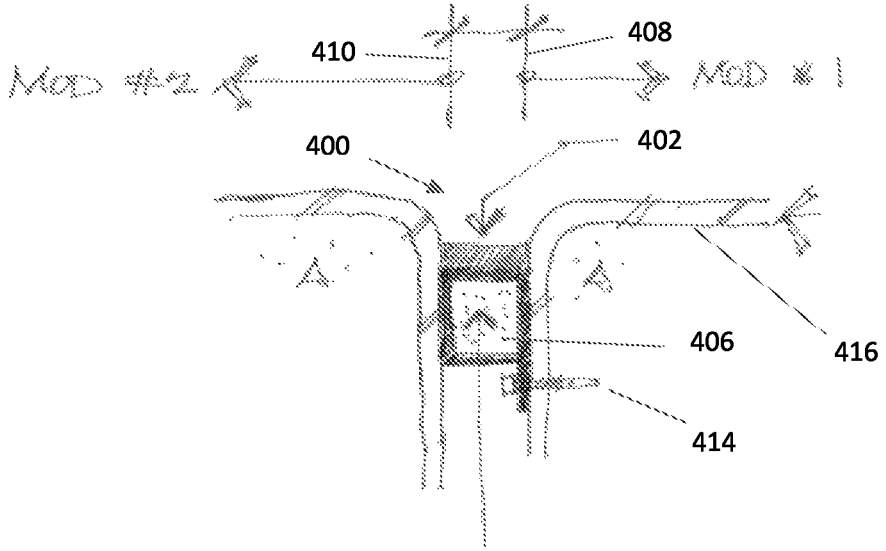
Figure 4C:
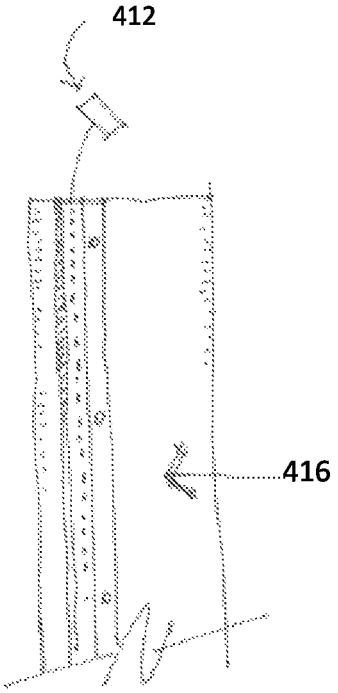

FIGS. 4A-C show a self-sealing expanding internal gasket 400 according to an embodiment of the present disclosure. This is an expanding gasket 400 that can be used to seal vertical or horizontal gaps in inaccessible locations after module placement. For example, as shown in FIG. 4, there may be an approximately one-inch gap between a first module 408 and a second module 410. The gasket 400 is attached to one of the vertical structural members 416 by means of fasteners 414. The vertical structural member 416 may be a column 120 as shown in FIG. 1. The gasket 400 integrates an intumescent strip 402 to resist fire with a softer rubber material 404 to seal air/watertight between modular elements. Using a 2-component expanding foam 406, the gasket 400 can be pre-installed in a factory setting (horizontally or vertically) and activated (as described below) after installation on the project site. In modular construction, many joints between modules become inaccessible after placement beside on another. This gasket system allows a seal to be formed in a reliable and controlled manner by pulling a tab 412 by hand thereby releasing and activating the chemical expansion from the 2-component chemical system 406 from a convenient location during installation. The gasket 400, when activated, will provide fire resistance, an air and smoke seal, thermal insulation value, sound control and moisture resistance and offers an advantage over other modular installation systems on the market.

Figure 5A:
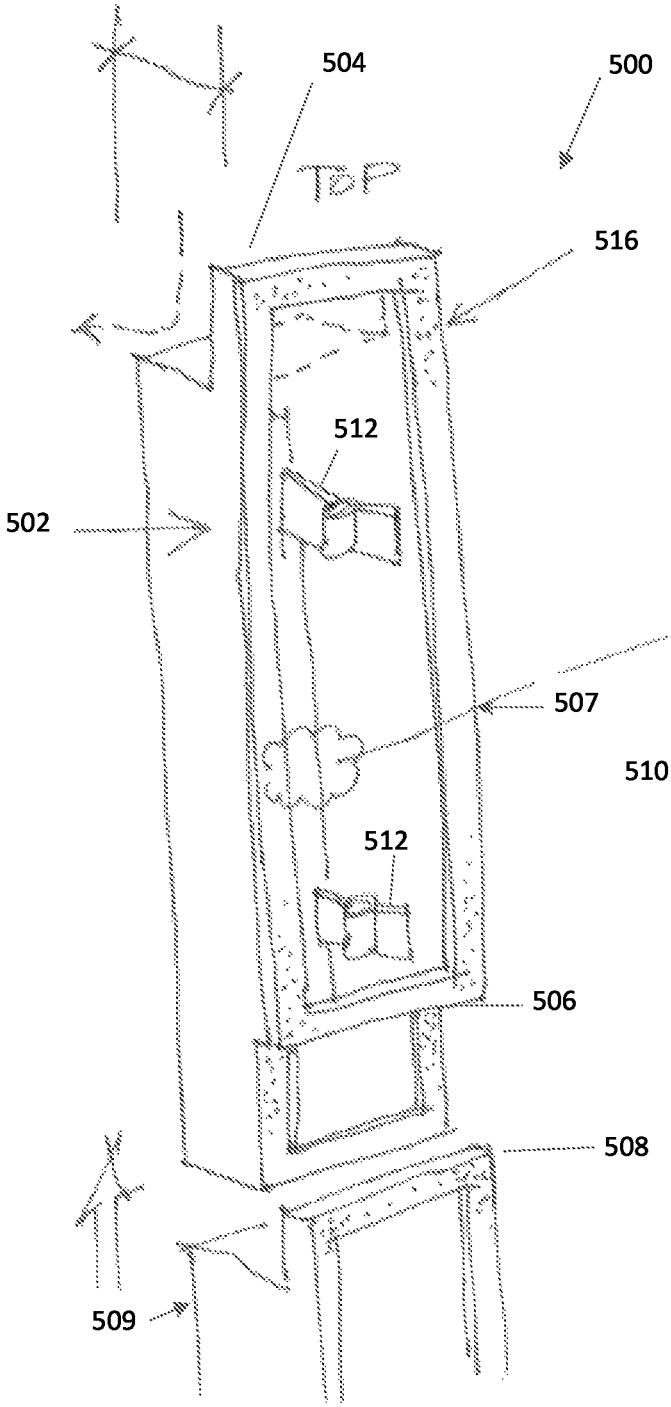
FIGS. 5A-B illustrate an exterior hinged envelope closure used with the modules shown in FIGS. 2A-2C according to one embodiment of the present disclosure.
Figure 5B:
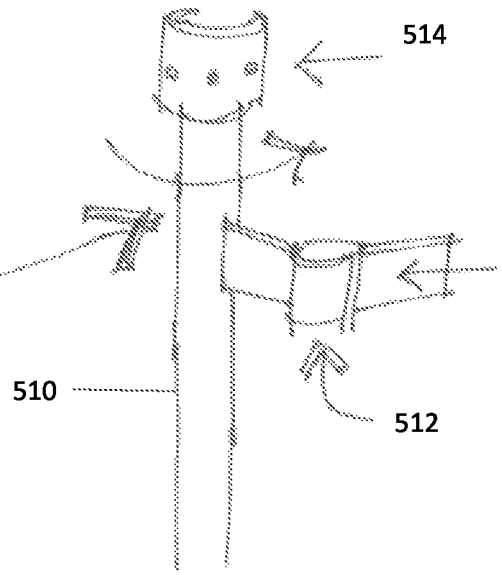
Figure 6:
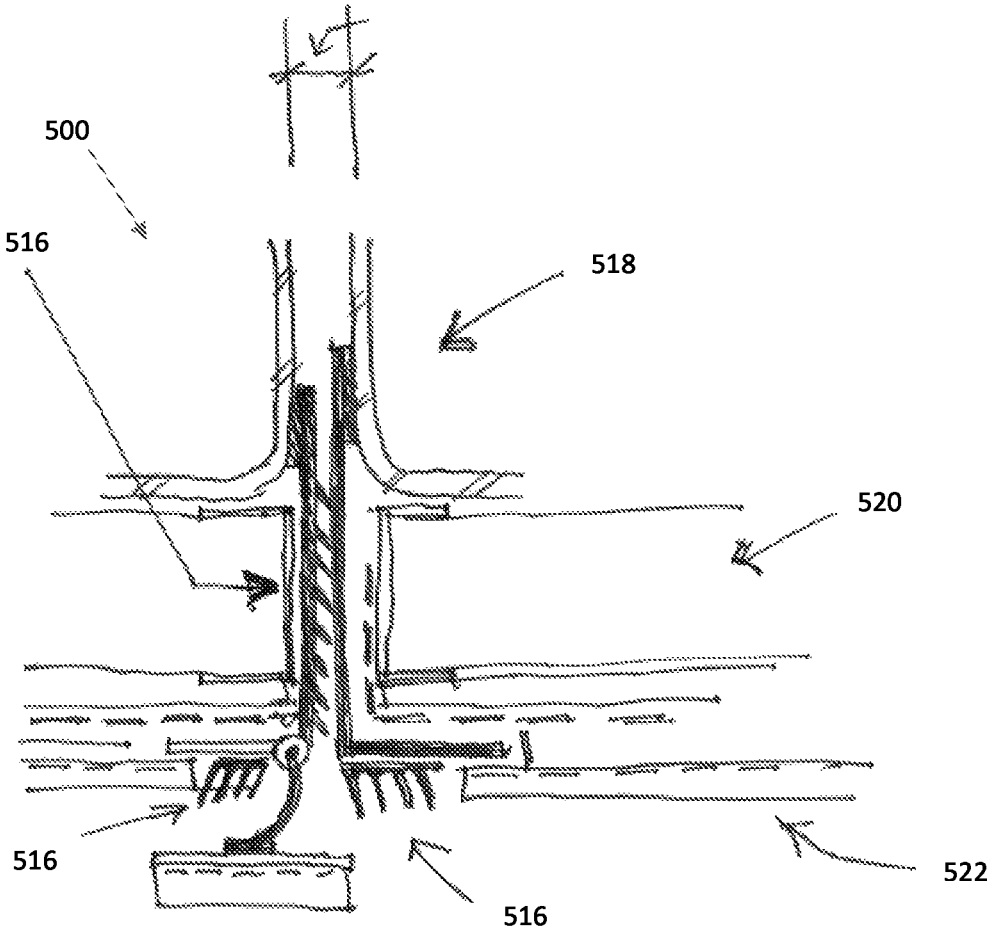
FIG. 6 illustrates an initial module seal used with the modules shown in FIGS. 2A-2C according to one embodiment of the present disclosure.

FIGS. 5A-B and 6 show an exterior hinged envelope exterior closure system 500 in according to an embodiment of the disclosure. The closure system 500 allows the exterior envelope 502 to be closed from above after module placement. In FIG. 5A the top portion 504 and bottom portions 506 of an upper module 507 are shown. The top portion 508 of a lower module 509 is also shown. The closure system 500 includes a shaft 510 with multiple hinges 512 attached thereto. The other end of the hinges is attached to a module, such as module 507. A slot 514 at the top of the shaft 510 allows the shaft to be turned using a tool (not shown) to fasten the envelope 502 to the module 507. The exterior closure system 5000 also includes gaskets 516 disposed between the exterior closure system 500 and the module 507 to provide an air and water-tight seal. FIG. 6 shows additional details of an embodiment of the closure system 500. A steel vertical column 518, the exterior wall assembly 520, and the exterior finish material 522 are shown. An exterior finish panel hinged are 524 compresses when closed against the gaskets 516. This closure system 500 allows the final sealing of vertical (and/or horizontal) joints between modules 507 to be completed from a safe location on the top or side of a module 507. With no requirement to access the exterior face of a high rise this system increases the speed, quality, and safety of final modular connections. It further allows the module 507 to have most of the exterior finishes applied in the factory where speed and quality are increased, and cost is reduced. This mechanical system ensures that human error is reduced in the application of the envelope and of its air and watertight qualities. The system works by being pre-attached to one module in the factory by means of a multi—hinged connection using hinges 512. This connection allows workers to turn the shaft 510 (from a safe location on the top of the module) using the tool (a ratchet bar or similar device) which then positions the closure to form a compression fitting between mating surfaces of two modules. Soft gasket materials 516 pre-installed in the factory will mate and form a permanent seal. Once tightened, a pin (not shown) will lock the envelope in its permanent position. Should future access to the joint for removal or maintenance be desired an access port can allow for future access.

Figure 7A:
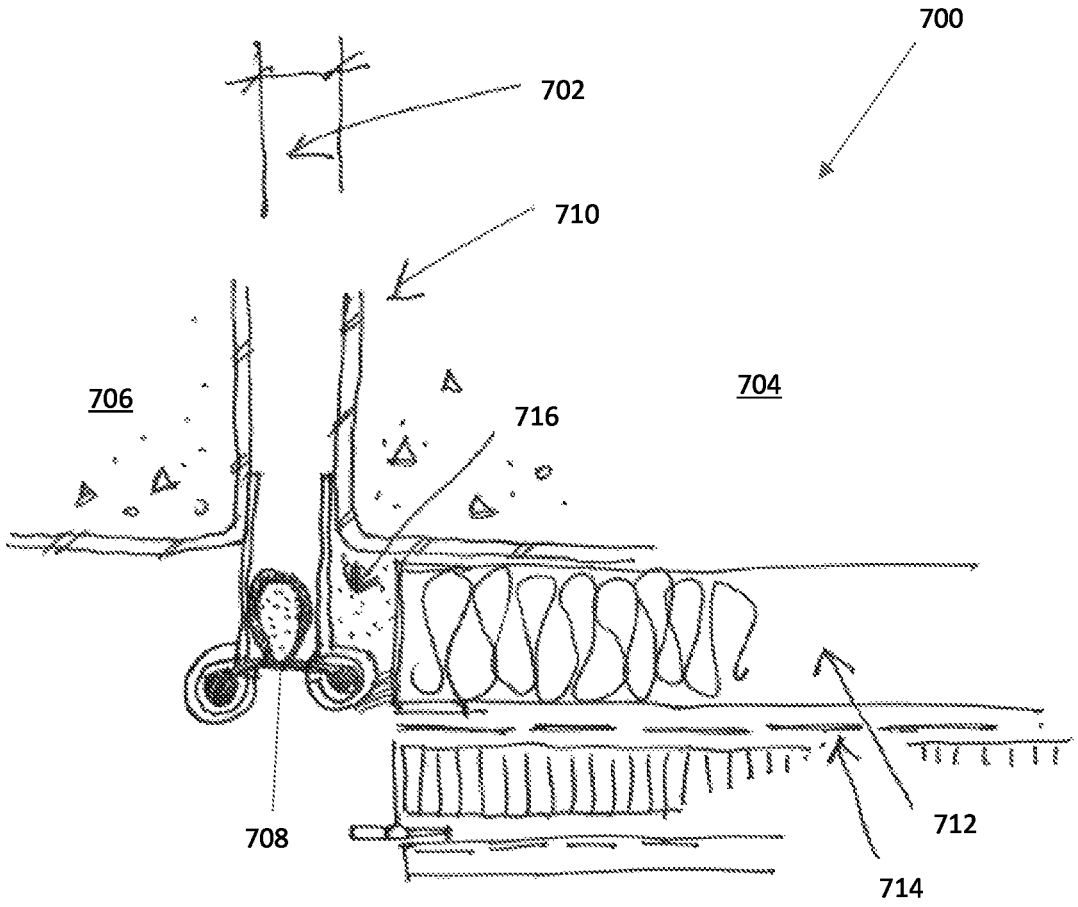
FIGS. 7A-D illustrate a final exterior seal used with the modules shown in FIGS. 2A-2C according to one embodiment of the present disclosure.
Figure 7D:
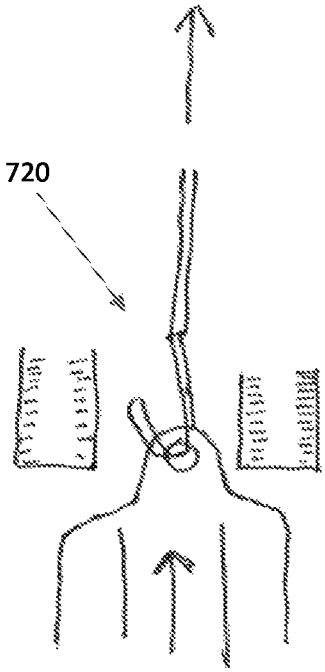
Figure 7B:
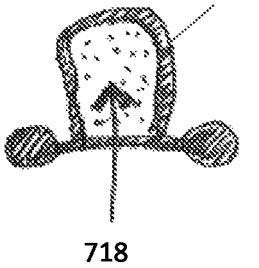
Figure 7C:
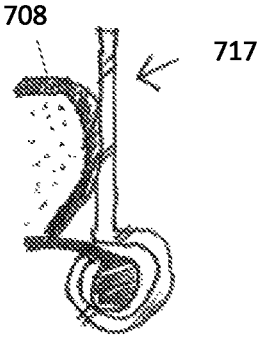

FIGS. 7A-D show a final exterior self-sealing weather gasket 700 according to an embodiment of the disclosure. This gasket 708 allows each vertical joint (or horizontal joint) 702 between modules 704, 706 to be rapidly sealed in the field during the erection sequence. FIG. 7A shows the vertical HSS tubes 710, an exterior wall (steel stud) 712, an air/water barrier 714, and insulation and calking 716. The gasket 708 includes a steel form track system 717 which may be installed at the factory where the module is produced. An insulated compression bubble 718 is contained within the steel form 717. The gasket 708 may work in conjunction with the closure system 500 used in FIGS. 5 and 6 or it may form a temporary weather closure to protect the completed interior finishes prior to a field installed exterior envelope being installed.

The gasket 708 will be installed from the top or side of the module 704, 706 by using a long rod 720 to insert the purpose-built gasket 708 into the steel form track system 717 pre-installed on each module. By pulling gasket towards the installer the gasket will compress into the gap/track between modules and form a watertight seal ensuring rain or snow will not enter the joint between modules.

Figure 8:
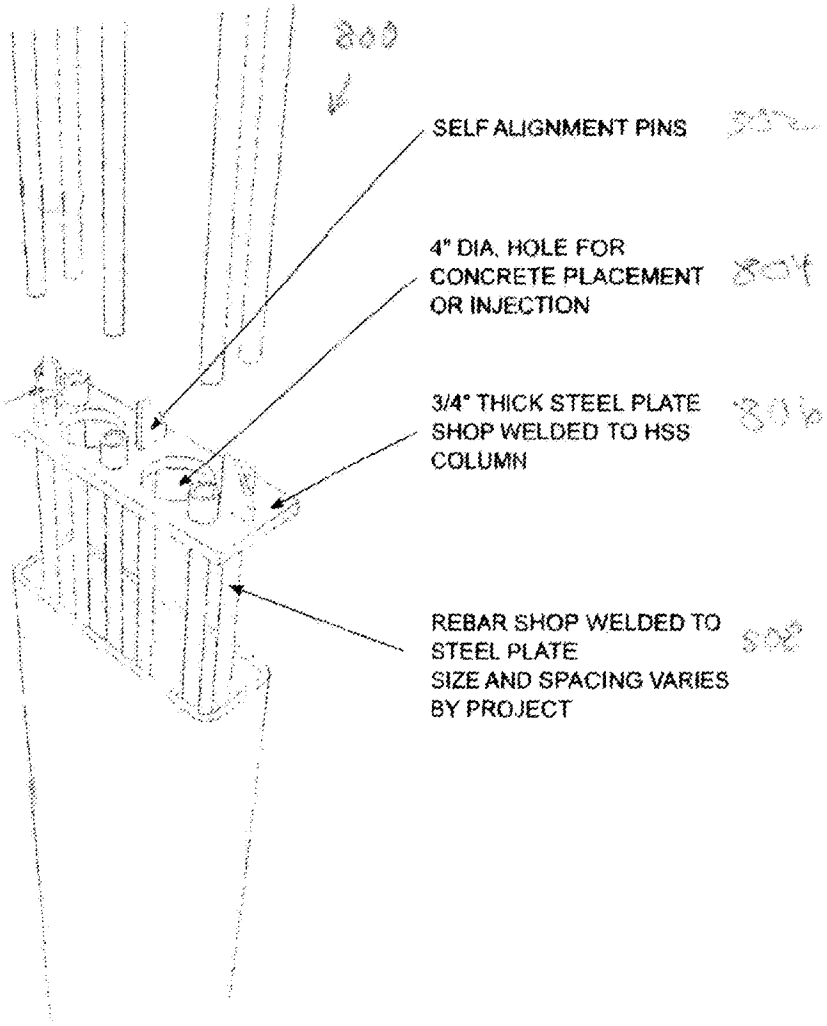
FIG. 8 shows a self-aligning column cap with integrated reinforcing in accordance with an embodiment of the present disclosure.

FIG. 8 shows a self-aligning column cap 800 with integrated reinforcing in accordance with an embodiment of the disclosure. The self-aligning column cap 800 as illustrated in FIG. 8 includes alignment pins 802, holes 804 for concrete placement or injection, a steel plate 806 welded to the HSS (Hollow Structural Section) column 810, reinforcing bars 812 installed on site after module placement, and a coupling 814 welded to the plate 806 to receive reinforming bars. The self-aligning column cap 800 serves two major functions. Firstly, it allows the modules to be set in place quickly and accurately on site to any desired horizontal tolerance (for example +/−5 mm of adjustment). Secondly it creates a stronger structural connection at the top/bottom of column where the upper and lower modules join together.

Figure 9B:
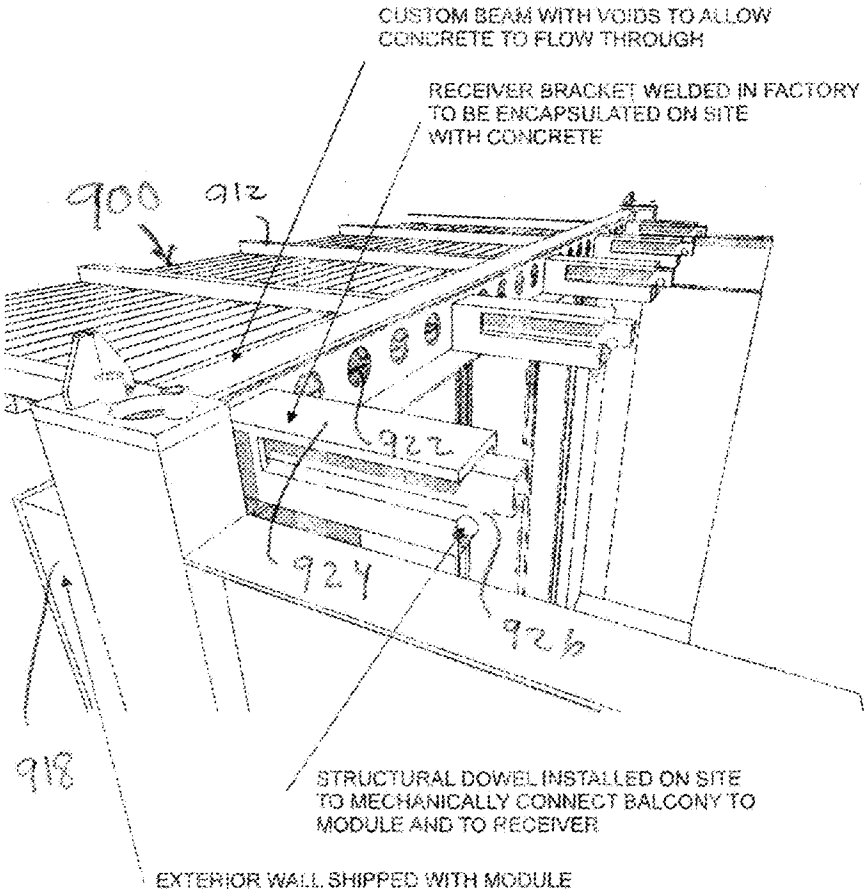
FIGS. 9A and 9B show a balcony unit that slides into a building module in accordance with an embodiment of the present disclosure.
Figure 9A:
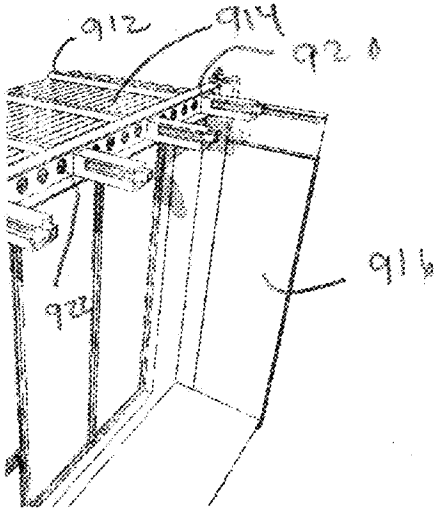

FIGS. 9A and 9B show a balcony unit that slides into a building module (such as module 110) in accordance with an embodiment of the present disclosure. The balcony 900 includes a plurality of horizontally disposed steel tubes 912 attached to metal decking 914. The metal decking 914 will receive concrete topping during on-site module installation. The balcony 900 may be pre-manufactured offsite and slid into a prefabricated building module 916 during on-site erection. The prefabricated building module 916 may include an exterior wall 918 that is shipped with the prefabricated building module 916. A custom beam 920 with voids 922 is installed adjacent to the balcony 900. The voids allow concrete to flow through, for example, to/from the balcony metal decking 914 to/from the surface of the prefabricated building module 916. A series of horizontal receiver brackets 924 are installed adjacent to the custom beam 920 and may be welded in the factory. The horizontal receiver brackets 924 include an opening to receive and retain the steel tubes 912 that are inserted into the openings during installation of the balcony 900. After installation of the balcony 900, the steel tubes 912 are long enough to protrude out of the end of the receiver brackets 924. The protruding end of the steel tubes 912 include an opening that receives a structural dowel 926, which is installed on site and mechanically connects the balcony 900 to the prefabricated building module 916 and the receiver bracket 924. Once the balcony 900 is installed, concrete is poured to cover the decking 914, flow through the openings 922 and to encapsulate the receiver brackets 924, the steel tubes 912, and the structural dowels 926. There are numerous advantages achieved by the balcony 900. The construction of components off site is less expensive than on-site construction. Also, since it is cast into concrete on site, it eliminates bolted connections. The balcony 900 may be slid into the prefabricated building module 900 on the ground or during vertical erection.

From the above description, it can be seen that the present invention provides a system and method for implementing the embodiments of the invention. References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A building comprising:

at least one deck oriented in a horizontal plane;

a plurality of prefabricated modules disposed above and below the deck, wherein the prefabricated modules each include horizontal top and bottom panels, and vertical side panels;

a plurality of hollow structural members extending downwardly from around a periphery of each prefabricated module;

a gasket disposed in areas between adjacent prefabricated modules, the areas including inaccessible locations, wherein the gasket includes an enclosure containing a first material and a second material comprising a two-part expandable foam;

a manually actuatable mechanism including a separating element disposed within the enclosure that separates the first and second materials, the manually actuatable mechanism including an actuator member disposed outside the enclosure including a pull tab, the actuator member being accessible by a person outside the adjacent prefabricated modules, wherein when the pull tab is manually pulled the separating element is removed from between the first and second material causing the first and second material to contact each other and the two-part expandable foam to expand to be in sealing contact with adjacent panels of the adjacent prefabricated modules, thereby creating a seal between the adjacent prefabricated modules.

2. The building according to claim 1 wherein the gasket is attached to one of a plurality of vertical structural members.

3. The building according to claim 1 further comprising an intumescent strip attached to one side of the gasket to provide fire resistance to the gasket.

* * * * *